US005261263A

United States Patent [19]

Whitesell

[11] Patent Number: 5,261,263

[45] Date of Patent: Nov. 16, 1993

[54] CRIMPING PLIERS WITH RADIALLY OPPOSED JAWS

[76] Inventor: Eric J. Whitesell, 7226 Fargate Ter., San Diego, Calif. 92126-2581

[21] Appl. No.: 994,518

[22] Filed: Dec. 21, 1992

[51] Int. Cl.[5] ..... H01R 43/042; B25B 13/28

[52] U.S. Cl. ..... 72/410; 72/402; 29/751; 29/237; 81/90.2; 81/90.3; 30/90.1

[58] Field of Search ..... 72/402, 410, 409, 450; 29/751, 753, 237; 81/348, 350, 342, 90.2, 90.3; 30/90.1, 95

[56] References Cited

U.S. PATENT DOCUMENTS

| | | | |
|---|---|---|---|
| 3,111,157 | 11/1963 | Henry | 72/402 |
| 3,199,334 | 8/1965 | Holmes | 72/410 |
| 3,664,213 | 5/1972 | Anati | 81/90.2 |
| 4,578,982 | 4/1986 | Schrock | 72/402 |
| 4,727,742 | 3/1988 | Weaver | 72/402 |
| 5,203,197 | 4/1993 | Depperman | 72/402 |

FOREIGN PATENT DOCUMENTS

| | | | |
|---|---|---|---|
| 1042984 | 9/1983 | U.S.S.R. | 81/90.2 |
| 367221 | 2/1932 | United Kingdom | 72/410 |
| 2081144 | 2/1982 | United Kingdom | 72/402 |

*Primary Examiner*—Daniel C. Crane

[57] ABSTRACT

An improved crimping tool mechanism with radially opposed jaws that direct and balance compressive forces toward the center of the work, joining cylindrical connectors and cables with more reliable electrical and mechanical contact than that obtainable using linear motion devices.

6 Claims, 6 Drawing Sheets

CRIMPING PLIERS WITH RADIALLY OPPOSED JAWS

BACKGROUND

1. Field of Invention

This invention relates to crimping handtools, specifically to an improved mechanism for gripping and crimping cylindrical objects.

2. Discussion of Prior Art

A wide variety of cylindrical electrical connectors are crimped onto wires and coaxial cable. Although the field of crimping tools is a crowded art, most crimping tools invented to data have jaws which apply a linearly opposed force concentrated along the plane where the jaws converge. The resulting deformation of cylindrical connectors is consequently asymmetric, resulting in a crimp which is less than ideal with respect to electrical reliability and mechanical strength. On the other hand, crimping tools designed to apply a radial force are substantially more complex in design and correspondingly more expensive to manufacture than those with linear action.

OBJECTS AND ADVANTAGES

Accordingly, in addition to the objects and advantages described herein, several objects and advantages of the radial pliers of this invention are:

(a) to provide an improved mechanism for gripping cylindrical workpieces with radially balanced force;

(b) to provide a method of equally and uniformly deforming electrical connectors whereby optimally reliable electrical and mechanical contact with wires and coaxial cables is achieved;

(c) to provide a method for increasing leverage as contact increases whereby the effort required by the operator is minimized.

Further objects and advantages of the radial pliers will become apparent from a consideration of the drawings and ensuing description.

DRAWING FIGURES

REFERENCE NUMERALS IN DRAWINGS

Figure 1:
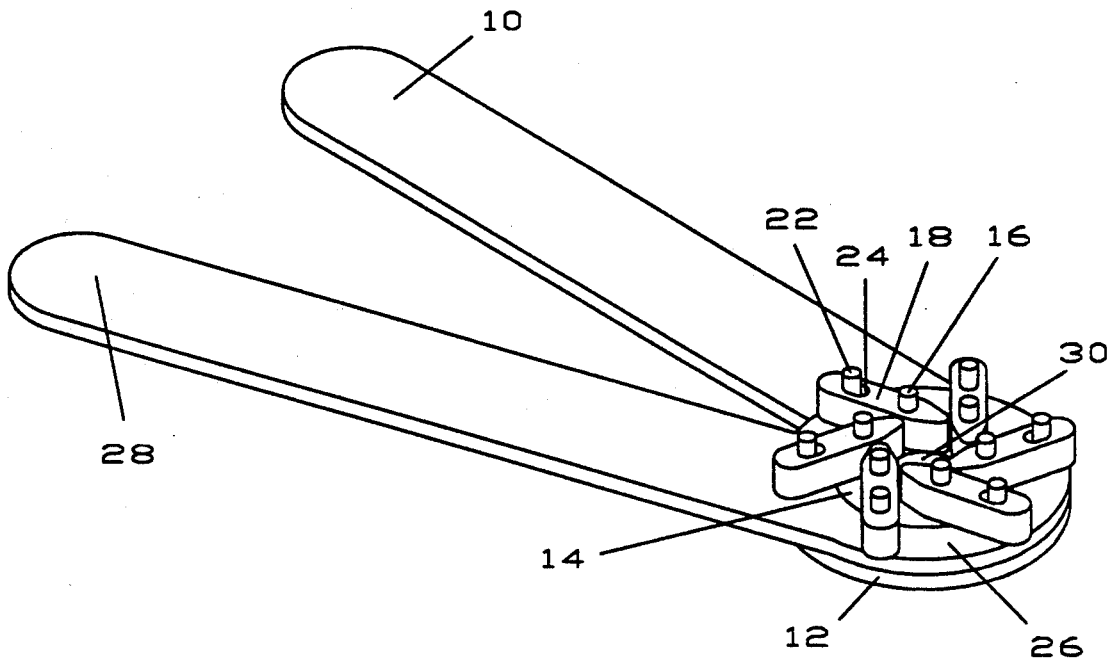
FIG. 1 shows a perspective view of the radial pliers opened.

10: upper handle
12: annular ring
14: inner annular bearing
16: inner pivots
18: levers
22: outer pivots
24: cam slots
26: outer annular bearing
28: lower handle
30: common aperture

DESCRIPTION-DRAWINGS 1-6

Figure 2:
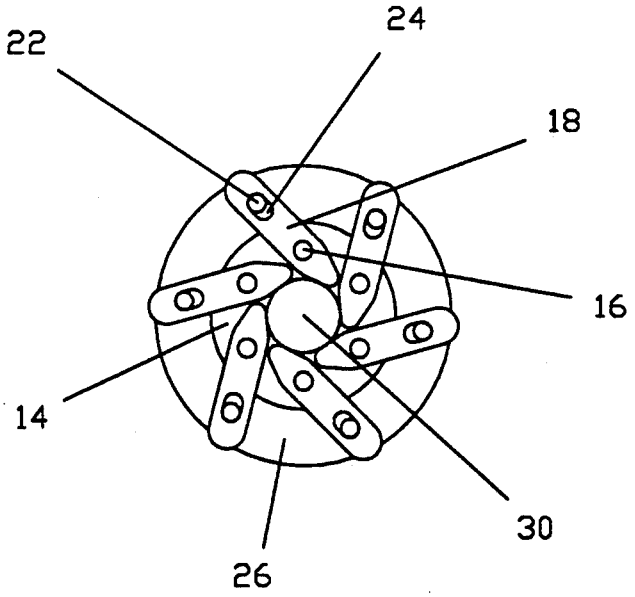
FIG. 2 shows a top view detail of the radial pliers opened, handles omitted.

A typical embodiment of the radial pliers of this invention is illustrated in the perspective view of FIG. 1 and in the top view detail of FIG. 2. To avoid overcrowding the figures with numbers, only one element within a group of identical elements is referenced by a number. The radial pliers has an upper handle 10 terminating in an annular ring 12. Annular ring 12 is fixed to an inner annular bearing 14 to which a plurality of identical inner pivots 16 are radially arranged. A plurality of identical levers 18 are radially arranged and pivotally coupled to inner pivots 16, enclosing a common aperture 30. A plurality of identical cam slots 24 on levers 18 engage a plurality of identical outer pivots 22. Outer pivots 22 are radially arranged on an outer annular bearing 26, which is concentric with inner annular bearing 14. Outer annular bearing 26 is the termination of a lower handle 28.

Figure 5:
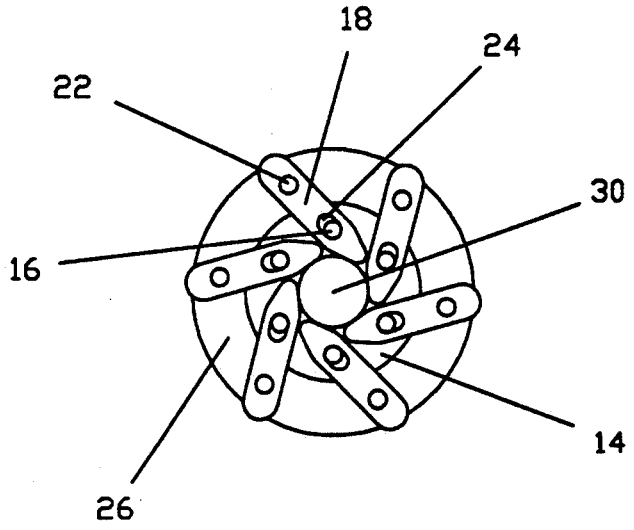
FIG. 5 shows a top view detail of the radial pliers opened, alternate cam slots, handles omitted.

A second embodiment of the radial pliers of this invention is illustrated in the top view detail of FIG. 5. The description is the same as for the first embodiment, except that cam slots 24 on levers 18 engage inner pivots 16 rather than outer pivots 22.

OPERATION-FIGS. 1-6

Referring to the first embodiment shown in the perspective view of FIG. 1 and in the top view detail of FIG. 2, a cylindrical workpiece (not shown) is inserted into common aperture 30.

Figure 3:
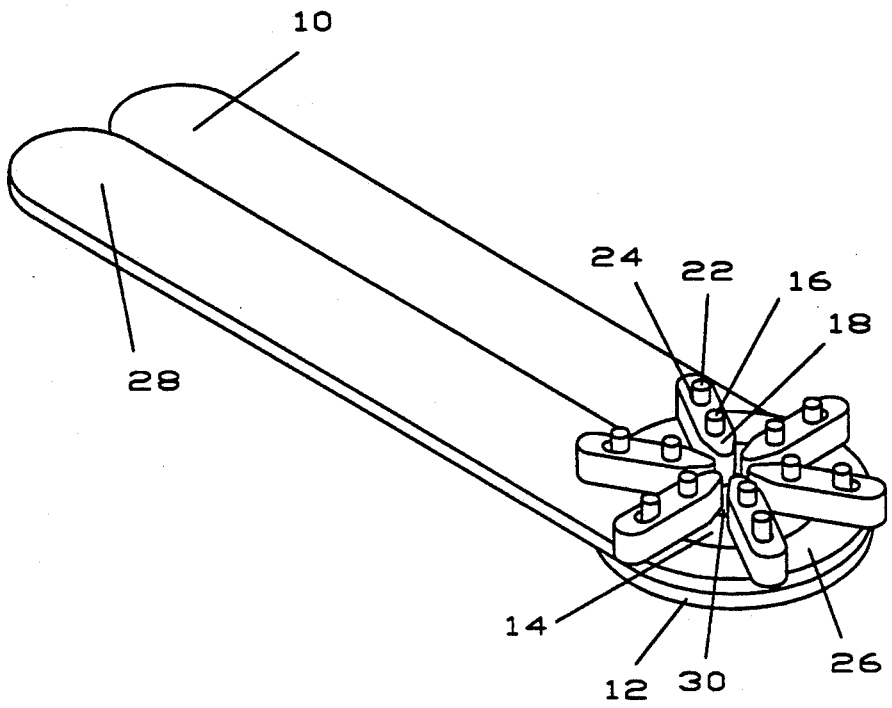
FIG. 3 shows a perspective view of radial pliers closed.
Figure 4:
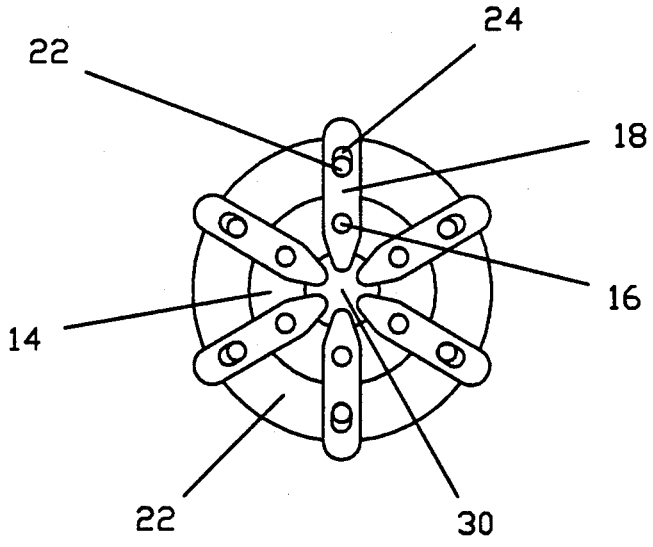
FIG. 4 shows a top view detail of the radial pliers closed, handles omitted.

The perspective view of FIG. 3 and the top view detail of FIG. 4 show lower handle 28 closed to upper handle 10, causing clockwise rotation of outer annular bearing 26 and outer pivots 22 with respect to inner annular bearing 14 and inner pivots 16. Levers 18 rotate individually in a common clockwise direction on inner pivots 16 as outer pivots 22 slide forward in cam slots 24, thus closing common aperture 30. As contact between levers 18 and cylindrical workpiece (not shown) increases, radial displacement of levers 18 caused by rotation on inner pivots 16 decreases, conversely causing the leverage from displacement of upper handle 10 with respect to lower handle 28 to increase. When lower handle 28 is fully closed to upper handle 10, cylindrical workpiece (not shown) is uniformly deformed by levers 18.

Conversely, as shown in the perspective view of FIG. 1 and in the top view detail of FIG. 2, opening lower handle 28 away from upper handle 10 causes counterclockwise rotation of outer annular bearing 26 and outer pivots 22 with respect to inner annular bearing 14 and inner pivots 16. Levers 18 rotate counterclockwise on inner pivots 16 as outer pivots 22 slide backward in cam slots 24, thus opening common aperture 30 and releasing workpiece (not shown).

Referring to the second embodiment illustrated in the top view detail of FIG. 5, cylindrical workpiece (not shown) is inserted into common aperture 30.

Figure 6:
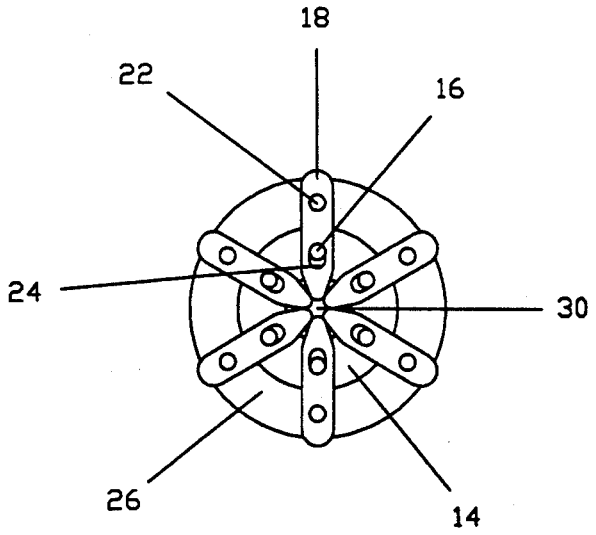
FIG. 6 shows a top view detail of the radial pliers closed, alternate cam slots, handles omitted.
Figure 7:
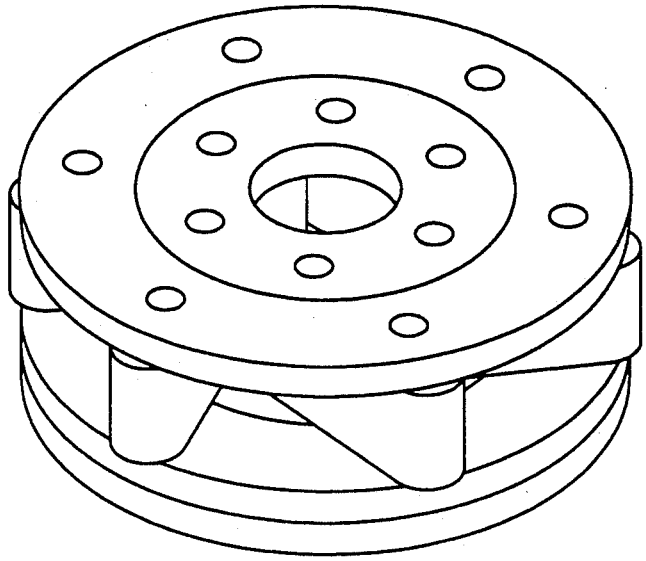
FIG. 7 shows a perspective view of the radial pliers with added opposing annular bearings, handles omitted.
Figure 8:
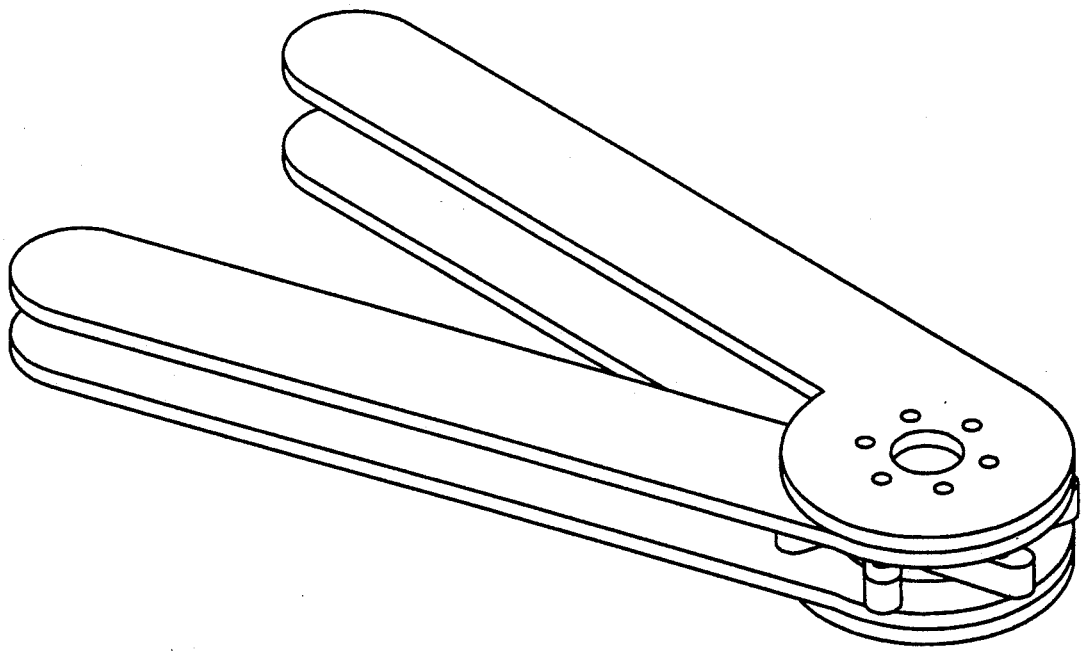
FIG. 8 shows a perspective view of the radial pliers with added opposing annular bearings and handles.
Figure 9:
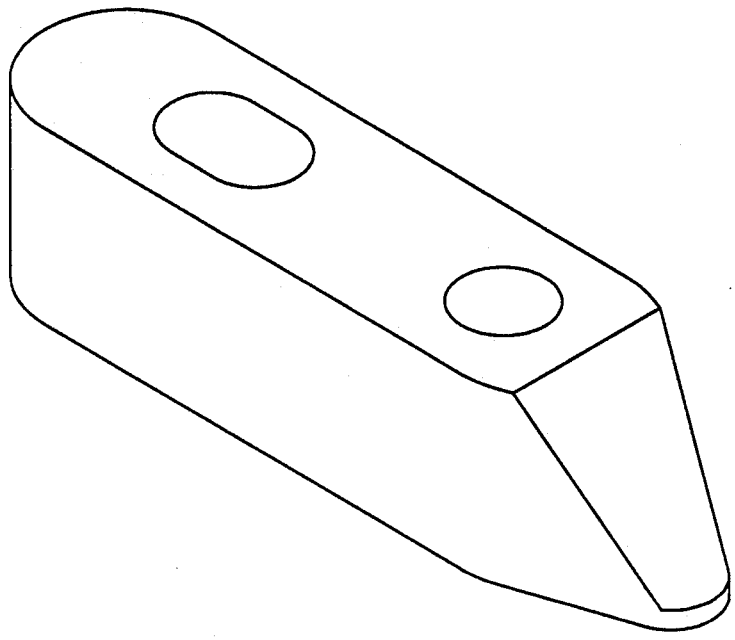
FIG. 9 shows a magnified perspective view of a lever of the radial pliers modified for cutting.
Figure 10:
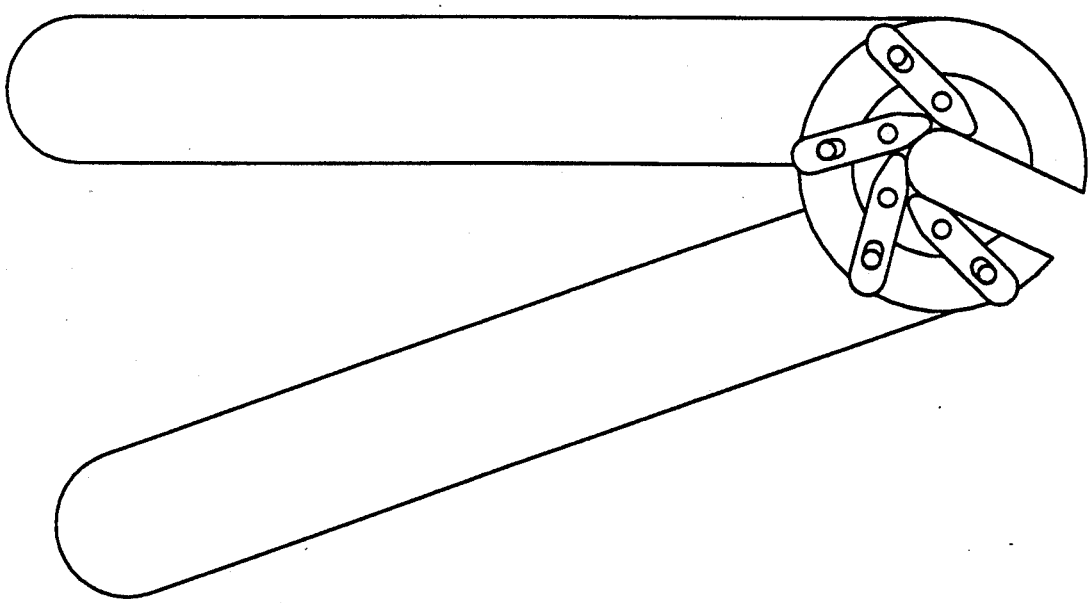
FIG. 10 shows a top view of the radial pliers with an open-ended aperture.
Figure 11:
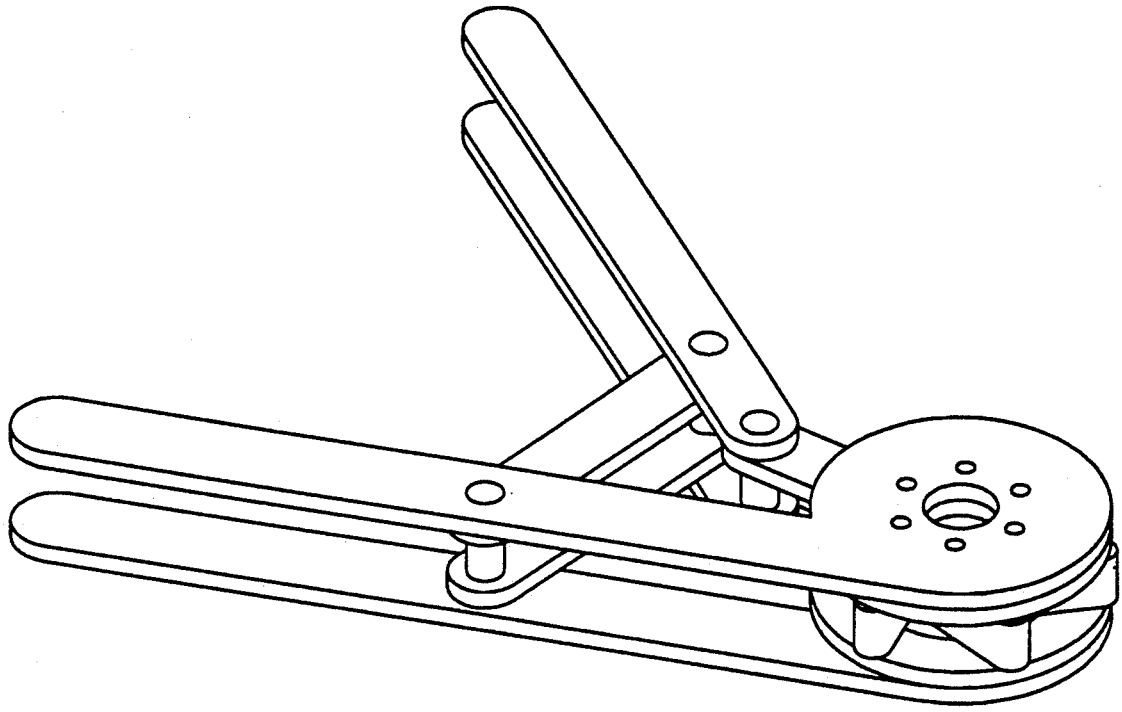
FIG. 11 shows a perspective view of the radial pliers with added opposing annular bearings and handles arranged with a linkage.

The top view detail of FIG. 6 shows the result of clockwise rotation of outer annular bearing 26 and outer pivots 22 with respect to inner annular bearing 14 and inner pivots 16. Levers 18 rotate individually in a common clockwise direction on outer pivots 22 as inner pivots 16 slide backward in cam slots 24, thus closing common aperture 30 and deforming workpiece (not shown).

Conversely, the top view detail of FIG. 5 shows the result of counterclockwise rotation of outer annular bearing 26 and outer pivots 22 with respect to inner annular bearing 14 and inner pivots 16. Levers 18 rotate individually in a common counterclockwise direction on outer pivots 22 as inner pivots 16 slide forward in cam slots 24, thus opening common aperture 30 and releasing workpiece (not shown).

CONCLUSION, RAMIFICATIONS, AND SCOPE OF INVENTION

Accordingly, the reader will see that the radial pliers of this invention is not only a substantial improvement on what is described in the prior art for gripping and crimping cylindrical workpieces, but is also easy to use and economically practical to manufacture, having few unique elements and a simple design.

While the above description contains many specifics, these should not be construed as limitations on the scope of the invention, but rather as an exemplification of preferred embodiments thereof. Other embodiments of the method of the invention are possible, for example: the number, shape, and composition of the levers may be altered; the shape and position of the cam slots may be varied; the common aperture may be modified to provide an open end on the radial pliers, and the handles provided for manual operation may be modified by adding a linkage for increased leverage, or omitted for automated operation. There are other uses for the radial pliers besides crimping, for instance, an adjustable wrench. The radial pliers may be used to cut tubing or to strip cable by modifying the shape of the levers. Accordingly, the scope of the invention should be determined not by the embodiments illustrated, but by the appended claims and their legal equivalents.

I claim:

1. A radial press for cylindrical workpieces, comprising:

a plurality of levers of predetermined thickness, width, length, and end shape appropriate to engaging a cylindrical workpiece, radially arranged around a common aperture;

a first outer annular bearing connected to one side of said plurality of said levers by a plurality of outer pivots, whereby said plurality of said levers is constrained to move and rotate in a plane parallel to said first outer annular bearing and perpendicular to the axes of rotation of said plurality of said outer pivots and said first outer annular bearing;

a first inner annular bearing having an outer radius substantially equal to the inner radius of said first outer annular bearing, and having an inner radius enclosing an area substantially equal to the area enclosed by said common aperture, concentrically arranged to said first outer annular bearing and connected to said one side of said plurality of said levers by a plurality of inner pivots, whereby said plurality of said levers is further constrained to move and rotate in a common direction with respect to the center of said common aperture, at least one of said plurality of inner pivots and said plurality of outer pivots includes elongated cam slots;

a first annular ring having an inner radius substantially equal to the inner radius of said first inner annular bearing and an outer radius substantially equal to the outer radius of said first outer annular bearing, arranged coaxially with said first inner annular bearing and said first outer annular bearing on said one side of said plurality of said inner pivots and said plurality of said outer pivots, fixed to said first inner annular bearing and substantially free to rotate against said first outer annular bearing, whereby the mechanical stability is improved;

a pair of handles arranged with said first outer annular bearing and said first annular ring for causing them to counterrotate by moving said handles towards and away from one another, thus causing said plurality of said levers to open and close said common aperture;

a second inner annular bearing and a second outer annular bearing arranged to the opposite side of said plurality of said levers by said plurality of said inner pivots and by said plurality of said outer pivots, whereby the mechanical stability is further improved.

2. The radial press recited in claim 1, further comprising a second annular ring having an inner radius substantially equal to the inner radius of said second inner annular bearing and having an outer radius substantially equal to the outer radius of said second outer annular bearing, arranged coaxially with said second inner annular bearing and said second outer annular bearing on the side opposite the inner and outer pivots, fixed to said second inner annular bearing, where said second annular ring is substantially free to rotate against said second outer annular bearing, whereby the mechanical stability is further improved.

3. The radial press recited in claim 2, wherein said pair of handles respectively terminate the annular rings and the outer annular bearings.

4. The radial press recited in claim 3, wherein said pair of handles further comprises a linkage arrangement, whereby the mechanical advantage afforded by said pair of said handles is improved.

5. The radial press recited in claim 1, wherein the predetermined end shape of said plurality of said levers causes said cylindrical workpiece to be crimped when engaged by said plurality of said levers.

6. The radial press recited in claim 1, wherein the predetermined end shape of said plurality of said levers causes said cylindrical workpiece to be cut when engaged by said plurality of said levers.

* * * * *